United States Patent [19]

Seaman et al.

[11] Patent Number: 4,644,649

[45] Date of Patent: Feb. 24, 1987

[54] APPARATUS FOR TRIMMING REEDS OF MUSICAL INSTRUMENTS

[76] Inventors: Roy C. Seaman, 11 E. Orange Grove Rd., #1023, Tucson, Ariz. 85704; Ronald D. McCaul, 1247 N. 2nd Ave., Tucson, Ariz. 85705

[21] Appl. No.: 780,426

[22] Filed: Sep. 26, 1985

[51] Int. Cl.[4] ..... B26B 13/00

[52] U.S. Cl. ..... 30/229; 30/249; 83/588; 144/2 R

[58] Field of Search ..... 144/2 R; 83/588, 589; 30/245, 249, 250, 253, 229

[56] References Cited

U.S. PATENT DOCUMENTS

| | | | |
|---|---|---|---|
| 1,467,806 | 9/1923 | Naujoks . | |
| 1,574,420 | 2/1926 | Finder . | |
| 1,635,004 | 7/1927 | Majeski . | |
| 1,723,674 | 8/1929 | Beard . | |
| 2,669,778 | 2/1954 | Cordier . | |
| 3,142,607 | 7/1964 | Scherer | 83/588 |
| 3,362,271 | 1/1968 | Willis | 83/588 |

*Primary Examiner*—W. D. Bray

*Attorney, Agent, or Firm*—Dressler, Goldsmith, Shore, Sutker & Milnamow, Ltd.

[57] ABSTRACT

Apparatus and method for trimming a reed used in conjunction with a musical instrument includes a support structure and at least one cutting instrument that can be manually coupled to and removed from the support structure. When the cutting instrument is positioned in the support structure, the reed is inserted between a die portion and a punching portion of the cutting instrument. A force applied to a lever mechanism coupled to the support member forces the punching member in to the plane of the die portion thereby trimming the edge of the reed. In addition to the convenient interchangeability of the cutting instruments permitting a plurality of reed sizes to be trimmed, the support structure can be fabricated from a single sheet of material. The number of parts needed for the apparatus is further reduced by having the lever mechanism comprised of two identical parts.

3 Claims, 4 Drawing Figures

APPARATUS FOR TRIMMING REEDS OF MUSICAL INSTRUMENTS

BACKGROUND OF THE INVENTION

1. Field of the Invention

This invention relates generally to the reed used in a wind musical instrument and, more particularly, to the shaping of the reed either prior to initial use of the reed or after some deterioration at the end of the reed has occurred as a result of use.

2. Description of the Related Art

It is known in the related art to provide a cutting instrument that includes a base or die member and a punching member for shaping the end of a (cane) reed. The reed is placed between the surface of the base (die) member and the punching member and force is applied to bring the punching member into the plane of the base member, thereby trimming or cutting the portion of the reed disposed between the two members of the cutting instrument. A device for accomplishing this reed cutting or trimming operation can be found in U.S. Pat. No. 1,723,674 by Beard. A similar cutting instrument is found in U.S. Pat. No. 1,635,004 by Majeski. However, this latter patent is embellished by having an additional structure attached to the punching member that has the function of both applying pressure to the cutting operation as well as the function of defining the position of the reed in the cutting instrument. Yet another similar apparatus is found in U.S. Pat. No. 1,574,420 by Finder, wherein a lever is coupled to the base member of the cutting instrument to provide additional force for trimming the end of the reed. Because the reed used with each type of wind musical instruments can have a different size, a cutting instrument with a plurality of punching members is shown in U.S. Pat. No. 1,467,806 by Naujoks et al. and in U.S. Pat. No. 2,110,052 by Miller. In each patent, the particular punching member determines the size of the reed that can be shaped thereby, each size of reed used by an associated wind musical instrument. Another variation of a reed trimming device is described in U.S. Pat. No. 2,669,778 by Cordier. In this patent, the cutting instrument has a general structure similar to other cutting instruments of the related art except that the cutting instrument can be coupled by means of screws to a frame structure. Also coupled to the frame structure is a level mechanism and has the additional feature of an adjustable mechanism at one end of the frame structure to engage the reed and to position the reed in a controllable manner.

In the foregoing patents, a plurality of reed sizes can be accommodated only by having individual reed trimming structures for the reeds associated with different types of reed instruments. Those references that described cutting instruments that can accommodate a plurality of reed sizes, such as the patent by Naujoks and the patent by Miller, are generally more bulky than the normal reed cutting device. In addition, if one of the cutting edges is compromised, then the entire reed cutting device must be replaced. The reference by Cordier can permit a plurality of sizes. However, the reed trimmer is heavy and additional time and effort must be expanded to first unscrew and remove one cutting member from the frame structure and then attach a second cutting member into the frame structure.

A need has therefore been felt for a reed trimming device that can accommodate a plurality of cutting instruments without unnecessary bulk and without unnecessary delay in changing from one cutting instrument to a different cutting instrument.

SUMMARY OF THE INVENTION

It is therefore an object of the present invention to provide an improved reed trimming device.

It is another object of the present invention to provide a wind musical instrument reed trimming device that can be used with a plurality of sizes of reeds.

It is a still further object of the present invention to provide for a reed trimming device in which cutting members suitable for a plurality of musical instrument reed sizes can be interchanged without undue manipulation.

It is a more particular object of the present invention to provide a reed trimming device that can provide cutting instruments that be removably attached to a frame structure of the reed trimming device.

It is yet another particular object of the present invention to provide a lever mechanism coupled to the frame, that can move one portion of the cutting instrument with respect to a second portion of the cutting instrument, thereby trimming a musical instrument reed to an appropriate shape.

It is yet another object of the present invention to provide a reed trimming device having a lever comprised of two identically shaped members for exerting a force resulting in the trimming of a musical instrument reed to a predetermined shape.

These and other features are accomplished, according to the present invention, by providing a cutting instrument and a support structure for removably engaging the cutting instrument. The cutting instrument has a die or base portion and a punching member, the punching member being held away from the base portion. Upon application of force capable of having an edge of the punching member become coplanar with the base portion, a portion of a reed extending between the base portion and the punching member is cut or trimmed. The support structure is fabricated to provide grooves for removably engaging the cutting instrument. Coupled to the support structure is a lever comprised of two identical members that, by lifting one of the lever members, the second lever member exerts a force on the punching member forcing the punching member into the plane of the base portion and cutting any portion of a reed extending between the punching member and the base portion. A spring clip is coupled to the support structure to removably engage the musical instrument reed during the cutting operation.

These and other features of the present invention will be understood upon the reading the following description along with the drawings.

DESCRIPTION OF THE PREFERRED EMBODIMENT

Detailed Description of the Figures

Figure 1:
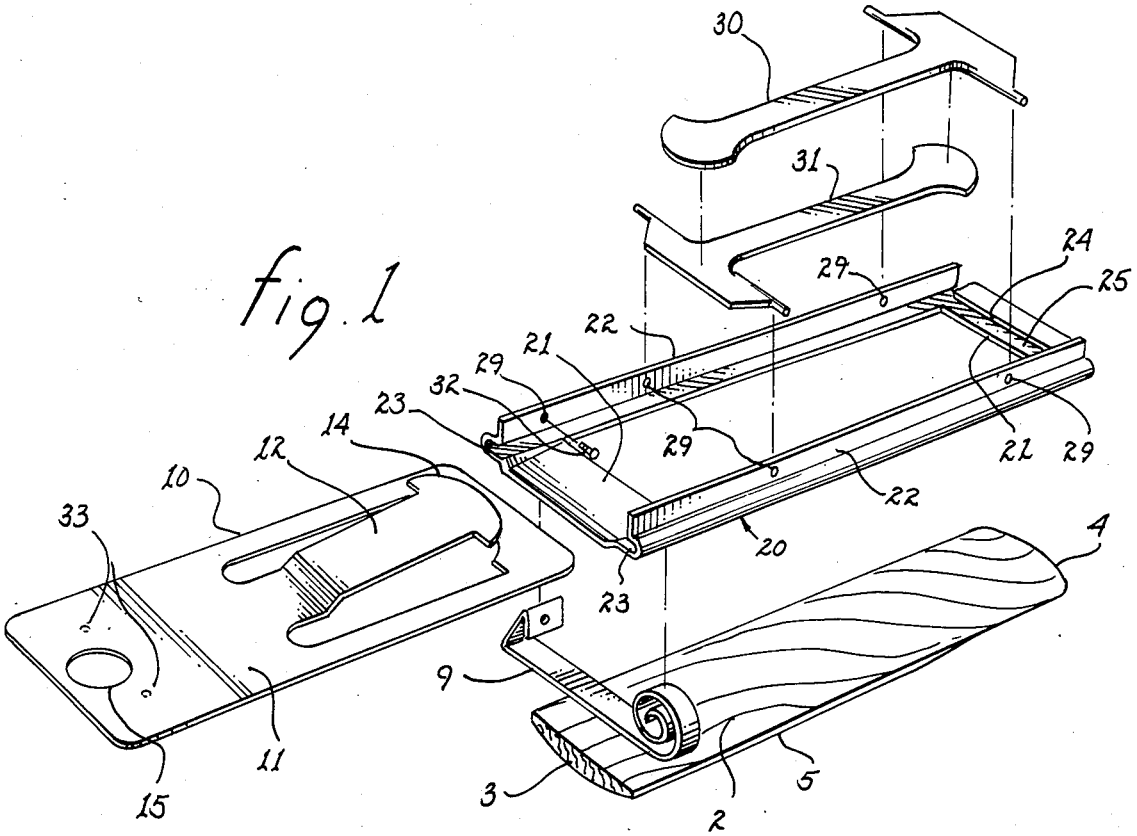
FIG. 1 is an exploded view of a reed trimming apparatus of the instant invention.
Figure 2A:
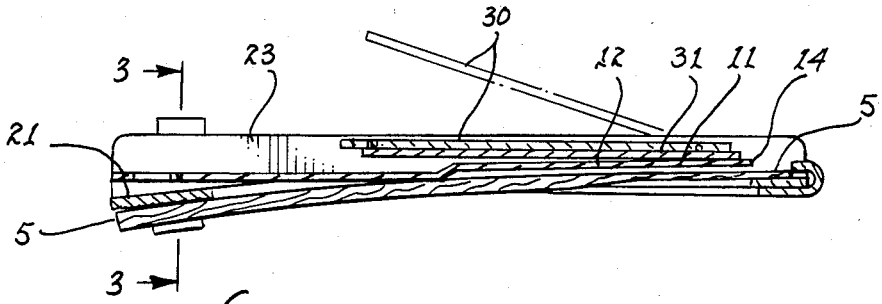
FIG. 2*a* is a cross-section view along the length of the reed trimming apparatus of the present invention.
Figure 2B:
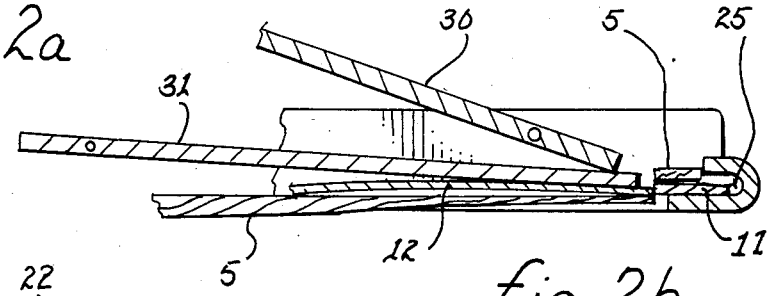
FIG. 2*b* is a cross-section view along the length of a portion of the reed trimming apparatus of the present invention illustrating the action of the lever in the trimming operation.

Referring first to FIG. 1, an exploded view of the device for trimming a wind musical instrument reed is shown. A cane reed 5 typically has a rounded configuration 3 at one end that becomes flat at the other end with a generally curved edge 4. The curved end of the musical instrument reed can become frayed with usage and periodically the frayed end needs to be trimmed to maintain the desired tonal qualities of the wind musical instrument. The cutting instrument 10 for trimming the reed includes a planar or die portion 11 with a punching member or tongue portion 12, typically fabricated from the planar portion 11. The punching member is fabricated to extend over the planar portion 11 of the cutting instrument 10 permitting the reed to extend therebetween. When the reed is inserted into a portion of the opening between the planar or die portion 11 and the punching member 12, the punching member 12 can be forced into the plane of planar portion 11. The portion of the reed extending through the opening is trimmed off by the action of the edge 14 of punching member 11 against the opposing edge of planar portion 11. The cutting instrument includes a friction hole 15 for convenient application of a horizontal force to the cutting instrument. A support or frame structure 20 for engaging the cutting instrument 10 is shown. The support structure includes a planar region 21 upon which the removable cutting instrument 10 can be placed. On either side edge of the support structure 20 are grooves 23 that engage sides cutting instrument 10. The cutting instrument 10 is pushed forward in grooves 23 until the forward edge of the cutting instrument enters groove 25 at the front of the support structure 20. The support structure includes sides 22 for strengthening the support structure and for providing a structure to engage associated apparatus. In particular, two members of the lever mechanism 30 and 31 have structure that permits insertion into apertures 29 in the side 22. Spring clip 9 has an aperture that permits one side spring clip to be coupled to an aperture 29 by means of a screw 32. The second end of the spring clip 9 engages the second side of support structure by means of the shape and resiliency of the spring clip. When the cutting instrument 10 is inserted in the support structure 20 and is positioned completely in the groove 25, then the reed 5 can be inserted between the clip spring and the support structure and positioned to extend between planar structure 10 and the punching member 12 of the cutting instrument. The position of reed 5 is limited by the edge 24 of the structure of the support structure 20 forming groove 25 in the forward direction and by dimples 33 in the cutting instrument 10. These dimples limit the withdrawal of the cutting instrument 10 from the support structure 20 by contacting the rear planar region of the support structure. The reed 5 can be withdrawn slightly if a lesser amount of reed is trimmed for the reed edge 4. When the end of member 31 not engaging the apertures 29 is raised, a force is exerted on member 30 which in turn is transmitted to punching member 12. The punching member 12 is forced into the plane of base portion 11 of the cutting instrument 10 and the reed consequently has a portion cut therefrom. Cutting instrument 10 can be easily removed from the support structure 20 and a different cutting instrument 10 inserted in the support structure.

Referring next to FIG. *2a* and to FIG. *2b*, a cross-sectional view illustrating the trimming operation is shown. Planar portion 11 of cutting instrument 12 is inserted into groove 25 and the reed 5 is positioned between punching member 12 and base portion 11 with the forward edge 4 of reed 5 limited by the forward surface 24 of the member of the support structure forming groove 25. When lever member 30 is lifted, a force is exerted on level member 31 and consequently on the forward portion of punching member 12. When lever 30 is lifted sufficiently, the forward portion of the reed in the vicinity of cutting edge 4 will be cut away, the amount of reed trimmed determined by the distance of reed edge 4 from groove edge 24.

Figure 3:
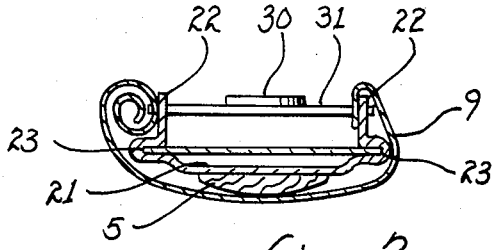
FIG. 3 is a cross-sectional view across the width of the present invention.

Referring to FIG. 3, a cross-sectional view of the reed trimming apparatus is shown. The reed 5 is positioned between the spring clip 9 and a planar portion of the support structure 20. The base portion or structure 11 of cutting instrument 10 is engaged by grooves 23 in the sides 22 of support structure 20 and include apertures for engaging lever members 30 and 31.

Operation of the Preferred Embodiment

The present invention is designed to trim easily wind musical instrument reeds of a plurality of sizes. The reed sizes that can be accommodated is determined by the structure of punching member formed in the cutting instrument. The plurality of cutting instruments can be easily coupled to and removed from the support structure with a minimum of effort. In addition, an adjustment can be made in the amount of reed that is clipped from reed edge 4 by varying the position of the reed cutting instrument 10 with rspect to groove edge 24. The support structure 20 can be fabricated of a single sheet of material, the grooves 23, sides 22 and the front groove 25 being created by appropriate cutting and bending the planar material forming the support structure. The manner in which the planar material is formed to create the support structure provides both structure strength and light weight. In addition, the members 30 and 31 both can be identically shaped, thereby minimizing the number of different components needed to form the reed trimming apparatus.

The above description is included to illustrate the operation of the preferred embodiment and is not intended to limit the scope of the invention. The scope of the invention is to be limited only by the following claims. From the foregoing description, many variations will be apparent to one skilled in the art which would yet be encompassed by the spirit and scope of the invention.

What is claimed is:

1. An apparatus for trimming a reed of a musical instrument, said apparatus comprising:

cutting means including a planar portion, and an integral punching tongue portion movable relative to said planar portion for cooperation therewith for trimming an edge of said reed positioned between said tongue portion and said planar portion;

a frame structure for supporting and removably receiving said cutting means, said frame structure defining a pair of laterally spaced, inwardly opening, opposed grooves for respectively removably slidably receiving laterally opposed marginal edges of said planar portion of said cutting means, said frame structure including a pair of laterally spaced side portions respectively positioned adjacent to said opposed grooves, said frame structure further defining another groove at a front portion thereof for receiving a forward edge of said cutting means; and lever means pivotally mounted on said side portions of said frame structure, said lever means being operatively engageable with said tongue portion of said cutting means, whereby said lever means is pivotable relative to said frame structure for effecting trimming of the edge portion of said reed positioned between said tongue portion and said planar portion, said cutting means being removable from said frame structure to permit replacement of said cutting means for cutting reeds of different sizes.

2. An apparatus for trimming a reed in accordance with claim 1, including spring clip means for removably securing said reed to said frame structure.

3. An apparatus for trimming a reed in accordance with claim 1, wherein said lever means comprises a first lever pivotally mounted on said side portions of said frame structure for engagement with said tongue portion of said cutting means, and a second lever pivotally mounted on said side portions of said frame structure for engagement with said first lever to thereby move said first lever for moving said tongue portion of said cutting means relative to said planar portion thereof.

* * * * *